United States Patent [19]

McCormack

[11] 3,939,764

[45] Feb. 24, 1976

[54] APPARATUS FOR MANUFACTURING WOODEN TRUSSES AND THE LIKE

[76] Inventor: Gerald M. McCormack, 3395 Fillmore St., Eugene, Oreg. 97405

[22] Filed: Sept. 20, 1973

[21] Appl. No.: 399,143

[52] U.S. Cl. ..... 100/100; 100/218; 100/231; 100/272; 100/295; 100/DIG. 13; 227/152; 269/321 F

[51] Int. Cl.[2] ..... B30B 15/32

[58] Field of Search..... 100/DIG. 13, 231, 295, 100/100, 272, 218; 269/321 F, 321 A; 227/152, 110, 111; 144/288 C; 425/DIG. 220

[56] References Cited

UNITED STATES PATENTS

| | | | |
|---|---|---|---|
| 2,243,205 | 5/1941 | Hall | 100/272 X |
| 2,415,259 | 2/1947 | Renton | 269/321 A |
| 3,100,301 | 8/1963 | Black | 100/DIG. 13 |
| 3,255,943 | 6/1966 | Sanford | 227/152 |
| 3,358,589 | 12/1967 | Hentzschel | 100/100 |
| 3,379,354 | 4/1968 | Moehlenpah et al. | 100/DIG. 13 |
| 3,388,657 | 6/1968 | Jureit | 100/DIG. 13 |
| 3,458,099 | 7/1969 | Schick | 227/111 |
| 3,464,348 | 9/1969 | McGlinchey | 100/DIG. 13 |
| 3,487,430 | 12/1969 | Schmitt | 100/231 |
| 3,520,252 | 7/1970 | Jureit et al. | 100/272 |
| 3,530,790 | 9/1970 | Post | 100/100 |
| 3,605,608 | 9/1971 | Dagley | 100/DIG. 13 |
| 3,709,762 | 1/1973 | Chandler | 100/DIG. 13 |
| 3,824,919 | 7/1974 | Moehlenpah et al. | 100/231 X |

FOREIGN PATENTS OR APPLICATIONS

| | | | |
|---|---|---|---|
| 645,298 | 7/1962 | Canada | 269/321 F |

*Primary Examiner*—Billy J. Wilhite
*Attorney, Agent, or Firm*—Klarquist, Sparkman, Campbell, Leigh, Hall & Whinston

[57] ABSTRACT

An apparatus for fabricating wooden trusses includes a jig table composed of modular table sections cantilevered from supporting legs at one side and having a network of equally spaced indexing holes throughout the expanse of the table top. The wooden frame members making up the truss are assembled at their joints on pressure pads on the table top with the pads having pins which extend downwardly through the indexing holes. Air-operated lumber-locking devices hold the frame members together for fastening and are simultaneously releasable. A hydraulic wheel motor-driven lumber press is movable on a track along the jig table to press connector plates into the truss joints. The press has an open throat which receives the table top. A hydraulically actuated upper press platen overlies the full width of the table and a fixed lower platen underlies the table as the press moves along the table, stopping momentarily to press connector plates into the truss joints. The lower platen engages the pins of a pressure pad at each joint to lift the pad slightly from the table so that the connector plates are embedded within the truss joints without the pressure exerted by the press being applied to the table. The completed truss is rolled from the table after the lumber locks are released on extendable rollers provided on the table top.

31 Claims, 12 Drawing Figures

APPARATUS FOR MANUFACTURING WOODEN TRUSSES AND THE LIKE

BACKGROUND OF THE INVENTION

1. Field of the Invention

The present invention relates to apparatus for fabricating trusses and other frame structures composed of wooden frame members and more particularly to a jig table for assembling the frame members, a press for pressing metal connector plates into the butt joints of the assembled frame members, and associated components of each.

2. Description of the Prior Art

Prior systems for fabricating wooden trusses take various forms. However, in all forms there is some sort of means for supporting the wooden frame members to be joined during assembly and fastening, usually either a large jig table which supports the entire truss or a series of small support stands, each of which supports only one or a few of the several butt joints of the truss members. Means are also provided for pressing a pair of connector plates into the wooden frame members at each butt joint. The latter means usually takes the form of a hydraulically actuated press, usually of the reciprocating type. However, there are also roller presses wherein an assembled truss supported on a movable table or platen is moved between a pair of rollers which squeeze the connector plates into the joint as the truss moves through the rollers.

There are basically two types of truss-fabricating systems. One type is exemplified by U.S. Pat. No. 3,443,513 in which a movable table supporting the assembled wooden frame members moves through a stationary press. The other type is exemplified by U.S. Pat. No. 3,603,244 in which a movable press moves along a stationary jig table supporting the truss members to be assembled. A major advantage of the stationary table-movable press system over the other system is that the former requires substantially no more space than needed to support the largest truss to be manufactured while the latter requires a work area at least twice the length of the longest truss made. Another substantial advantage of the movable press-stationary table system over the other system is that in the former the truss members themselves need not be moved, enabling the fabrication of a more accurate, tighter fitting, and thus stronger truss than is usually possible with the stationary press-movable table system.

The stationary table-movable press system is relatively new, primarily because of the problem of moving a press along a table without conflict with the table legs. Most of such systems take the form shown in U.S. Pat. No. 3,603,244 in which a closed-throated press spans the jig table and moves along tracks at opposite sides of the table. The table itself is supported on a complex system of special pivotable, so-called "grasshopper" legs which must swing from one position to another to permit the lower portion of the press to pass slowly beneath the jig table. In this system, press forces are transmitted between upper and lower press platens through the jig table, so the table must be of sufficient strength and thickness to withstand these high forces.

Another type of fixed stand-movable press system is shown in U.S. Pat. No. 3,068,484 in which individual stands shiftable along tracks support the individual butt joints of the truss frame members and a small press movable along an overhead track is moved from stand to stand manually to embed connector plates at each joint. Each stand is shifted to a new position to correspond to the changed positions of a truss joint each time a different type or size of truss is to be produced.

Still another type of truss-manufacturing system is exemplified by U.S. Pat. Nos. 3,530,790 and 3,460,465 in which separate track-mounted truss support stands and integral presses are provided at each separate truss joint to support the truss and embed the connector plates. This type of system also requires shifting of each separate press-stand under the last-described circumstances.

SUMMARY OF THE INVENTION

The truss-manufacturing system of the present invention is an improvement over prior stationary table-movable press systems in that it is capable of a higher rate of truss production, is less complex and less expensive to produce, is easier to maintain and provides a simplified system of truss fabrication. The system includes both an improved jig table and associated components of simplified, low-cost construction and an improved press particularly designed for use with the improved table.

Specific unique features of the jig table include:

1. a cantilevered construction providing an open side and unobstructed space beneath the table so that a press can move freely along the table with a lower press platen extending beneath the full width of the table without the need for any complex movable leg construction;

2. modular table sections that can be joined together side by side to form tables of varying lengths to meet different truss requirements and which can also be joined back to back to form a table of twice the normal width for large trusses;

3. a table top having a network of perforations or indexing holes therethrough for positioning pressure pads and other jig accessories on the table;

4. pressure pads for supporting both the truss framework at its joints and a lumber-clamping mechanism, with the pads having downwardly extending positioning pins which extend through the indexing holes for coaction with the press to lift the pads from the table just prior to a pressing operation, whereby press forces are transmitted from an upper press platen through the pressure pads to a lower press platen without being transmitted through the table, thereby enabling use of a table of lightweight, economical construction;

5. an air-operated lumber-locking means which can be individually manually applied to clamp the wood members together at their joints prior to and during the pressing operation and which are simultaneously air-releasable to enable quick removal of a completed truss from the jig table; and

6. rollers carried by the jig table which are extendable following completion of a truss to raise the truss from its pads and roll it from the table.

Specific unique features of the press include:

1. an open throat construction which especially adapts the press for use with the aforementioned cantilever-type jig table;

2. mounting of the press on rails which extend out of the way beneath the jig table;

3. a hydraulic wheel motor drive supplied with fluid from a pump driven by a press-mounted electric motor which takes its power from a power-conducting "third rail";

4. upper and lower press platens which extend throughout substantially the entire width of the jig table and through a substantial length thereof so that the press can be positioned for pressing more than one truss joint at a time;

5. a special double toggle-actuating mechanism for operating the movable upper press platen under progressively increasing applied pressure, thereby enabling the use of a relatively small power source to achieve the required press capacity; and 6. a lower platen with leading and trailing camming surfaces for engaging the downwardly projecting pins of the pressure pads on the jig table and lifting such pads from the table prior to a pressing operation so that press forces are not transmitted to the jig table.

Advantages of the truss-manufacturing system of the invention include its minimum space requirement, high-speed truss production, simplified construction of the jig table, press and related components for low system cost and low maintenance operation, improved safety features because of the absence of overhead components in the system and elimination of a need for lifting the completed trusses overhead from the table, less operator fatigue because of the sizing of the jig table to enable workers to operate the system standing alongside the table without the need for climbing onto and off the table at frequent intervals, and crews of minimum size for low production costs.

The foregoing and other objects, features and advantages of the present invention will become more apparent from the following detailed description which proceeds with reference to the accompanying drawings.

DETAILED DESCRIPTION

General System

Figure 1:
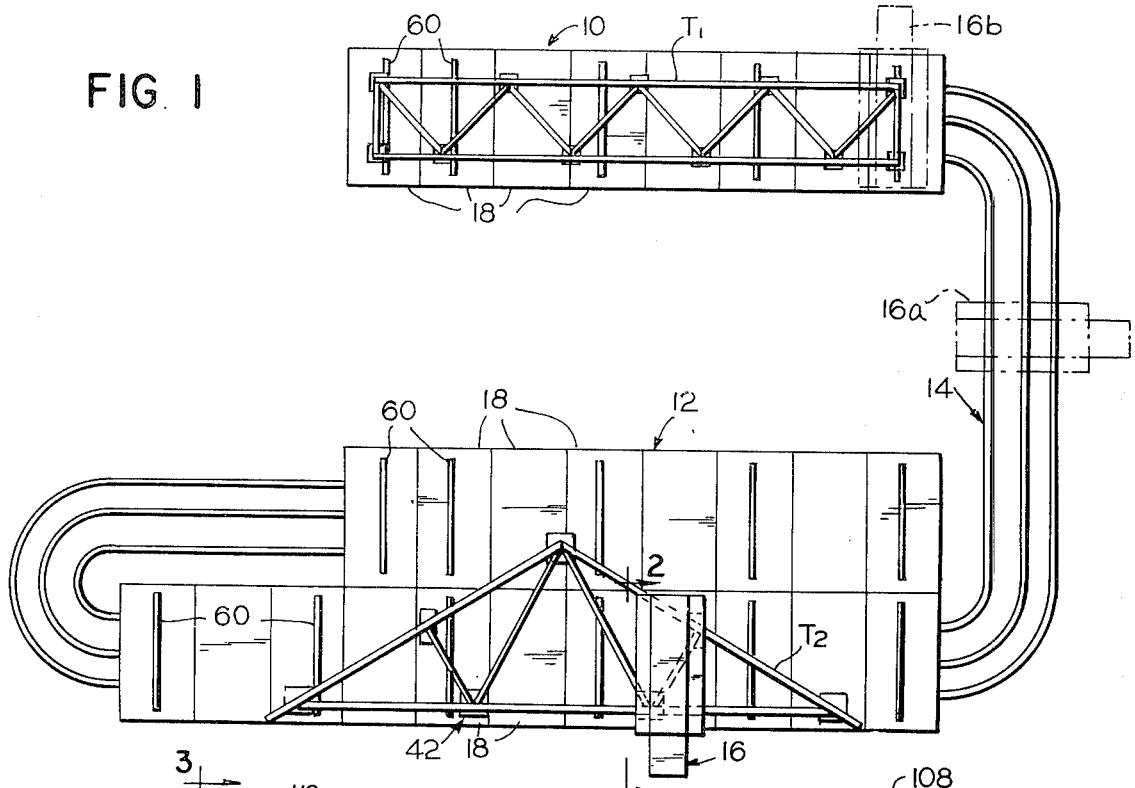
FIG. 1 is a small-scale plan view of a typical truss-manufacturing layout using a system of the invention.

With reference to FIG. 1 of the drawings, the illustrated truss-fabricating system includes two jig tables 10, 12 spaced from one another and interconnected by a three-rail trackway 14 which extends between the two tables and beneath each table. A self-propelled lumber press 16 is mounted for movement along the trackway between tables and to various positions along the length of each table, as indicated by the various positions **16*a*, 16*b* of the press 16 shown in phantom lines in FIG. 1. Each jig table 10, 12 is made up of plural modular table sections 18 of equal length and width joined together side by side in a suitable manner so as to make up a jig table of any desired length. As shown with respect to the larger jig table 12 of the two tables shown, the table sections 18** may also be joined back to back in a manner to be described to make up a table of double the normal width for use in manufacturing tall trusses.

Each table is designed to support the precut wooden frame members used in making up the wooden trusses T-1, T-2 both during assembly of the frame members in jigs at butt joints to form the truss and while fastening the frame members together at such joints using metal connector plates pressed into the joints by press 16.

FIG. 1 shows one possible layout of a truss-manufacturing plant using the fabricating system of the invention in such a way that a single press is used in fabricating two or more trusses simultaneously on two or more jig tables by shuttling the press along its trackway from one jig table to the other. While the frame members are being assembled into a truss and clamped in place at one jig table, the connector plates are embedded into an assembled truss by the press at the other table. After completion of a truss on one of the tables, the press is moved clear of the truss, the fastened truss joints are released from their jigs, and the truss is rolled from the table so that assembly of wooden frame members for the next truss on the same table can proceed.

Table Details

The details of construction of the jig table will be described particularly with reference to FIGS. 2, 4, 5, 6 and 7. As shown best in FIGS. 2 and 4, each table module 18 includes an angular pair of leg members 20 having a horizontal base portion **20*a* anchored to the floor 21 of the plant by suitable fasteners 22 and an angularly inclined leg portion 20*b* extending upwardly from one end of the base and terminating at a pair of clamps 23. The clamps of each leg receive a downwardly and inwardly inclined table portion 24*a* of a continuous one-piece horizontal table top 24 constructed of thin perforated metal plate. As thus shown and described, the horizontal table top portion 24 is cantilevered from the legs 20 at one side of the table to an unsupported opposite side of the table so that the table provides an open side and an unobstructed space beneath the table top for receiving the lower frame portion and lower platen of the lumber press 16, as clearly shown in FIG. 2. Each clamp 23 includes a slot 23*a* for receiving table top portion 24*a* and a clamping screw 23***b* threaded through a nut portion 23*c* of the clamp to clamp table top portion 24*a* securely to leg portion 20*b*.

Base portion 20*a* of each leg also mounts one of two wheel-supporting rails 26 and an angular bracket which supports power-conducting rails 29. The other wheel-supporting rail 30 is mounted directly on the floor 21, just beyond the free end of leg base 20*a*.

Although the table modules may be made in various sizes, it has been found in practice that a convenient size for the horizontal portion of the table top is approximately four feet wide by seven feet long. When modular sections of such size are joined together side by side as shown in FIG. 1, such modules enable a table to be made up in any desired length, in four-foot increments, with the table width being seven feet or multiples of seven feet if table sections are joined back to back as shown with respect to the table 12. A seven-foot table section enables workmen at either side of the resulting table to reach easily to any point on the table top. This eliminates the need for frequent climbing onto and off the table top to set up jigs and assemble the truss, thus reducing worker fatigue, at least when a table is only one table section wide, such as the table 10.

Figure 5:
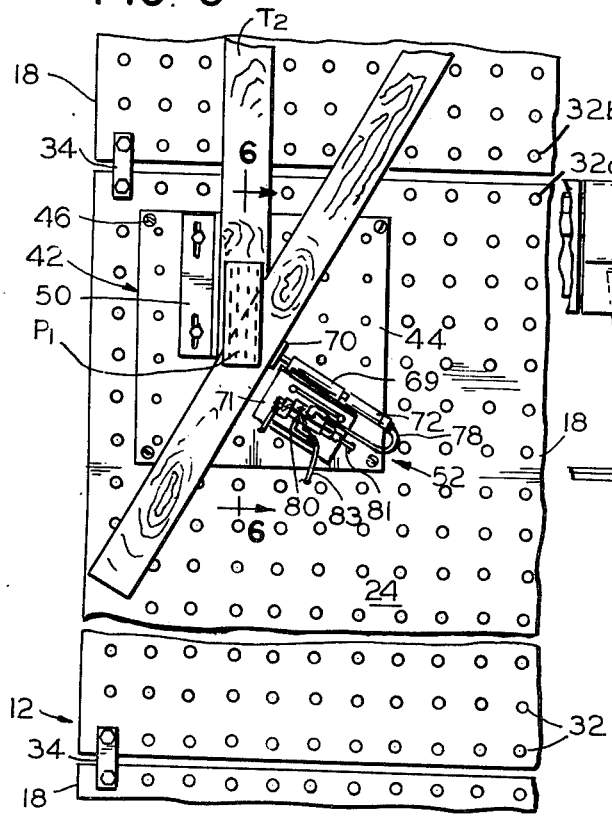
FIG. 5 is an enlarged plan view of a portion of the jig table of FIG. 1.
Figure 4:
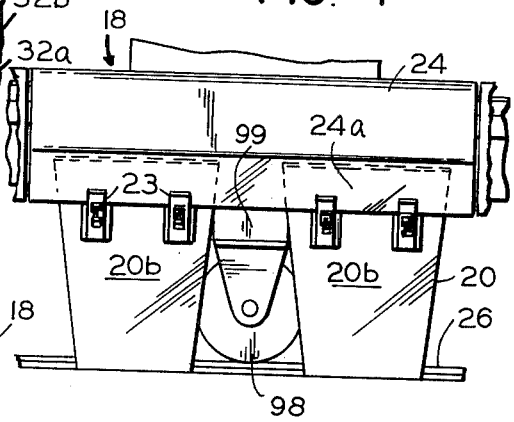
FIG. 4 is an end elevational view of a portion of the jig table of FIG. 2 taken approximately along the lines 4—4 of FIG. 2.
Figure 6:
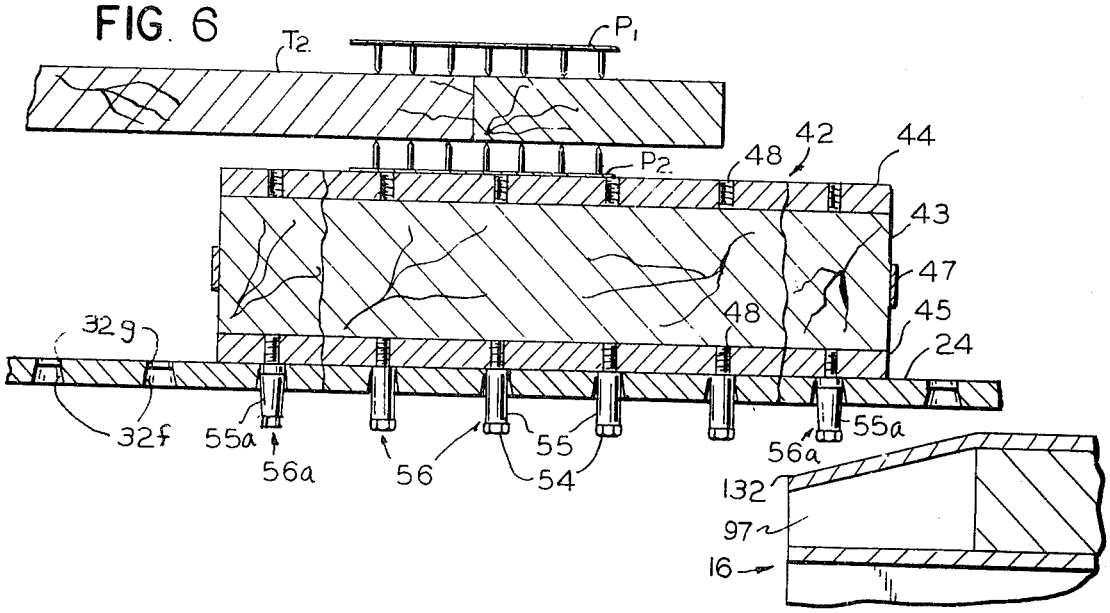
FIG. 6 is a vertical sectional view taken along the line 6—6 of FIG. 5 on a larger scale than FIG. 5 and also showing a leading edge portion of the lower platen of the press.
Figure 7:
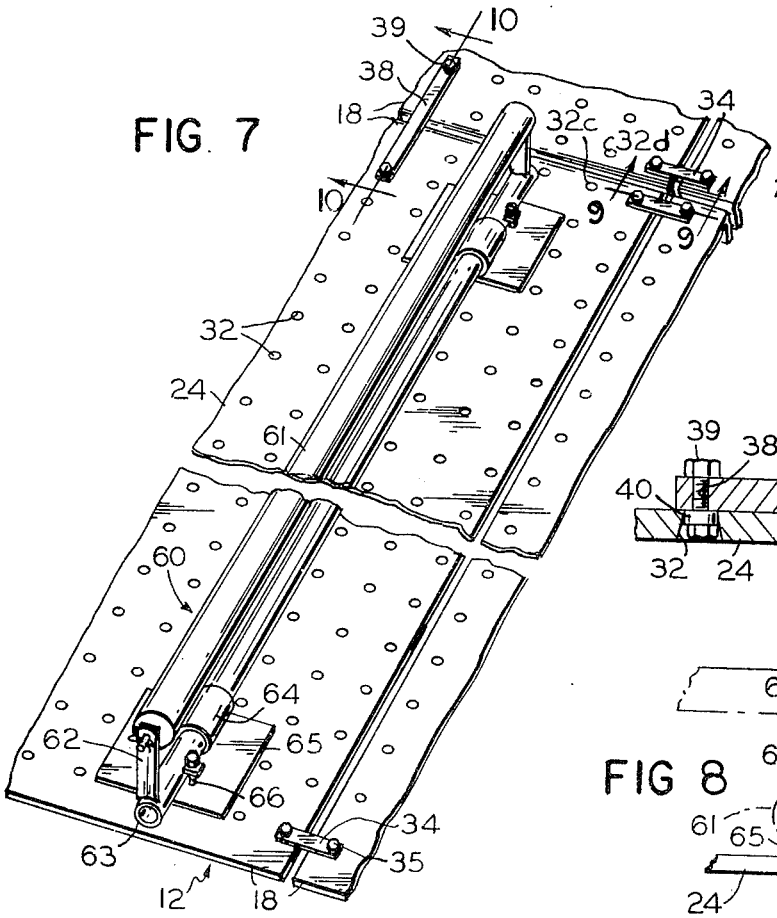
FIG. 7 is a perspective view of an upper portion of the jig table on approximately the same scale as FIG. 5 showing one of the truss rollers mounted thereon.

As shown most clearly in FIGS. 5, 6 and 7, each horizontal table top section 24 has a network of index holes 32 extending therethrough. The index holes are equally spaced apart in rows that extend parallel to both side edges and end edges of the table top. As an example, the indexing holes may be placed on three-inch centers, both lengthwise of and across the table. Whatever the spacing, it is maintained between table sections by the use of accurately dimensioned ties or spacer straps as shown in FIGS. 5, 7, 9 and 10, including tie straps 34 to secure the table sections together side to side and tie straps 38 to tie table sections together back to back. Side tie straps 34 maintain index hole spacing between the row of side edge index holes 32*a* of one table section and the adjoining row of side edge index holes 32*b* of the adjacent table section. Similarly, back tie straps 38 maintain the same spacing between the adjoining rows of back edge index holes 32*c* and 32*d* of adjacent back-to-back table sections.

It will be apparent from FIG. 6 that all index holes 32 are the same size. Each such hole has a tapered section 32*f* tapered outwardly in a downward direction from a short upper hole portion 32*g* of constant diameter. The general purpose of this feature is to enable the ready insertion into and release from such holes of positioning pins or fasteners of various jig table accessories applied to the surface of the jig table. More specific uses of the index hole will be explained shortly.

Figure 9:
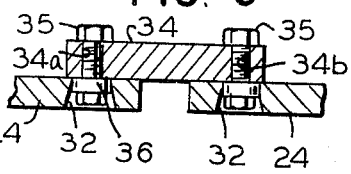
FIG. 9 is a vertical sectional view taken along the line 9—9 of FIG. 7 to show a side-to-side tie strap for the table sections.

As shown in FIG. 9, each side tie strap 34 has a hole 34*a*, 34*b* therethrough at each end. The center distance between such holes corresponds to the desired center distance between the edge rows of index holes of the side-by-side adjoining table sections. Threaded bolts 35 extend through strap holes 34*a*, 34*b* and head-first into the side edge index holes 32*a*, 32*b* of adjoining table sections. Each bolt is provided with a collar 36 which is dimensioned to fit under closer tolerances within the upper, constant diameter portion 32*g* of an index hole 32 to maintain accurately the desired spacing between the edge index holes of adjoining table sections. The head portion of bolt 35 retains collar 36 in position.

Figure 10:
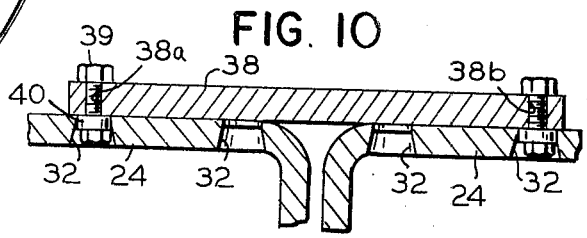
FIG. 10 is a vertical sectional view taken along the line 10—10 of FIG. 7 to show a back-to-back tie strap for the table sections.

As shown in FIG. 10, each back-to-back tie strap 38 has holes 38*a*, 38*b* therethrough at either end at twice the required center spacing between the edgemost rows of index holes 32*c*, 32*d* of back-to-back table sections 18. Bolts 39 with suitable close tolerance collars 40 fit within index holes 32 of the second row of such holes from the back edge of each adjoining table section in the manner described with respect to side tie straps 34. This arrangement maintains the adjoining edge rows of holes 32*c*, 32*d* at the required spacing.

A series of pressure pads 42, shown in FIGS. 1, 5 and 6, is positioned on the top of each jig table to support trusses at their joints. Each pressure pad 42 includes a central wooden core 42 sandwiched between a metal top plate 44 and a metal bottom plate 45. These three layers are secured together by corner screws 46 (FIG. 5). Core 43 is conveniently made up of a series of wooden blocks or layers of plywood bound together by a metal band 47. The top and bottom plates are provided with a network of threaded holes 48 spaced apart at intervals corresponding to the spacing between index holes 32 in the jig table with which it is used.

The threaded holes in the top plate of pad 42 are used for fastening accessories to the pad such as the conventional angular lumber stop member 50 and the lumber lock mechanism 52 shown in FIG. 5.

The threaded holes 48 in bottom plate 45 of the pad receive screws 54 surrounded by sleeves 55 which together define a series of positioning pins designated generally by the numeral 56. These pins are all of the same length and sized to project downwardly from the bottom plate 45 of the pressure pad through selected index holes 32 of the jig table to maintain the pressure pad in a desired position on the table during assembly of a truss.

All positioning pins 56 of a pad, except corner pins 56*a*, are provided with cylindrical sleeves 55 which are sized to fit loosely within the indexing holes 32 to facilitate easy insertion of the pins into the holes and removal therefrom. However, corner pins 56*a* are provided with sleeves 55*a* which taper inwardly in a downward direction from a short upper constant diameter portion sized to fit under close tolerances within the upper, constant diameter portion of an index hole. Thus corner pin sleeves 56*a* taper in a reverse direction from index holes 32. This feature enables the corner pins as well as the other pins to be readily inserted into and removed from the index holes of the table. Yet once the corner pins are in place, they restrain the pressure pad against any appreciable movement over the surface of the jig table.

A particularly important feature of the pin and index hole design is that it enables the pressure pad to be lifted gradually from the surface of the jig table in a rocking or tilting motion from one edge of the pad by the camming action of an inclined surface portion 132 of a lower platen 97 of press 16. Such surface acts progressively against the lower projecting ends of the pins as the press 16, shown at the right-hand side of FIG. 6, moves along beneath the jig table. This camming action eventually lifts the entire pad slightly from the table surface when the lower press platen is centered beneath such pad. This occurs just prior to the pressing operation at the truss joint supported on the pad. Thus as the press embeds the connector plates P-1 and P-2 into the truss joint, the pressing forces are transmitted from the upper press platen through the truss joint and pressure pad directly to the lower platen without being transmitted to the table itself. This feature enables the table to be composed of relatively lightweight, thin material just sufficient to support a truss and jig components described and thus provides an economical construction. When the press travels beyond a given pad, the weight of such pad and the truss portion supported by it causes the pad to drop back to the table surface.

The pressure pads may be made up in various sizes for use with various lumber sizes and various joints. For example, a three- or four-member joint would require a much larger pad than a two-member joint. In this connection it has been found that pressure pads made up in 12 by 12, 12 by 15, 12 by 18, 12 by 21 and 12 by 24 inch sizes will meet most, if not all, needs in the manufacture of trusses. Different thicknesses of pads must also be made up for different lumber thicknesses used in the manufacture of trusses. Most roof trusses would normally use lumber of nominal two-inch thickness with the thickness dimension positioned perpendicular to the surface of the jig table, so that pads of a single thickness can be used to fabricate all such trusses. However, some trusses, such as certain types of floor trusses, are manufactured with the width dimension of the lumber vertical or perpendicular to the jig table, in which case pads of lesser thickness than those used for roof trusses must be used. Pad thicknesses can be adjusted simply by adjusting the thickness of the wooden core so that the top and bottom plate thicknesses can be the same in all cases.

Figure 8:
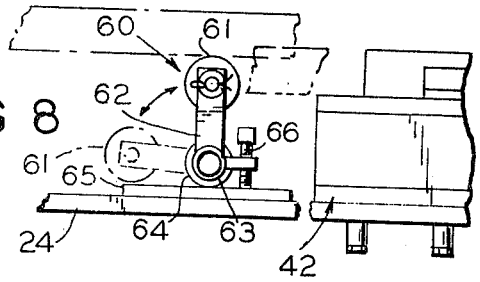
FIG. 8 is a foreshortened edge view of the table portion of FIG. 7 showing an end view of the truss roller in both its extended and retracted positions and also showing the relationship between the roller, a truss and a pressure pad.

Another important accessory of the jig table is the roller means 60 shown in FIGS. 7 and 8. Several of such roller means extend across the width of each table at intervals along the lengths of such tables so that a completed truss can be rolled endwise from one end of the table without the need for an overhead crane or other mechanism to lift the truss from the table. Each such roller means includes an elongate truss-engaging roll 61 rotatably mounted at each end on an arm 62 fixed to an end of a pivot tube 63. The pivot tube is rotatably mounted near each end within a pair of sleeve members 64 secured to metal base plates 65. Base plates 65 are secured to the jig table by suitable fasteners or pins (not shown) extending through selected index holes 32. With this arrangement the roller can be swung from a retracted position shown in dashed lines in FIG. 8 below the upper surface of pressure pads 42 on the table to an extended position above the tops of the pressure pads to lift a completed truss T from such pads. Thereafter the truss is simply rolled on the rollers from the table. The pivot tube 63 of the roller assembly is provided with a stop 66 which includes an ear projecting from the tube and an adjustment screw threaded through the ear for engaging the base plate to prevent upward swinging movement of roller arms 62 much beyond a vertical position.

Figure 11:
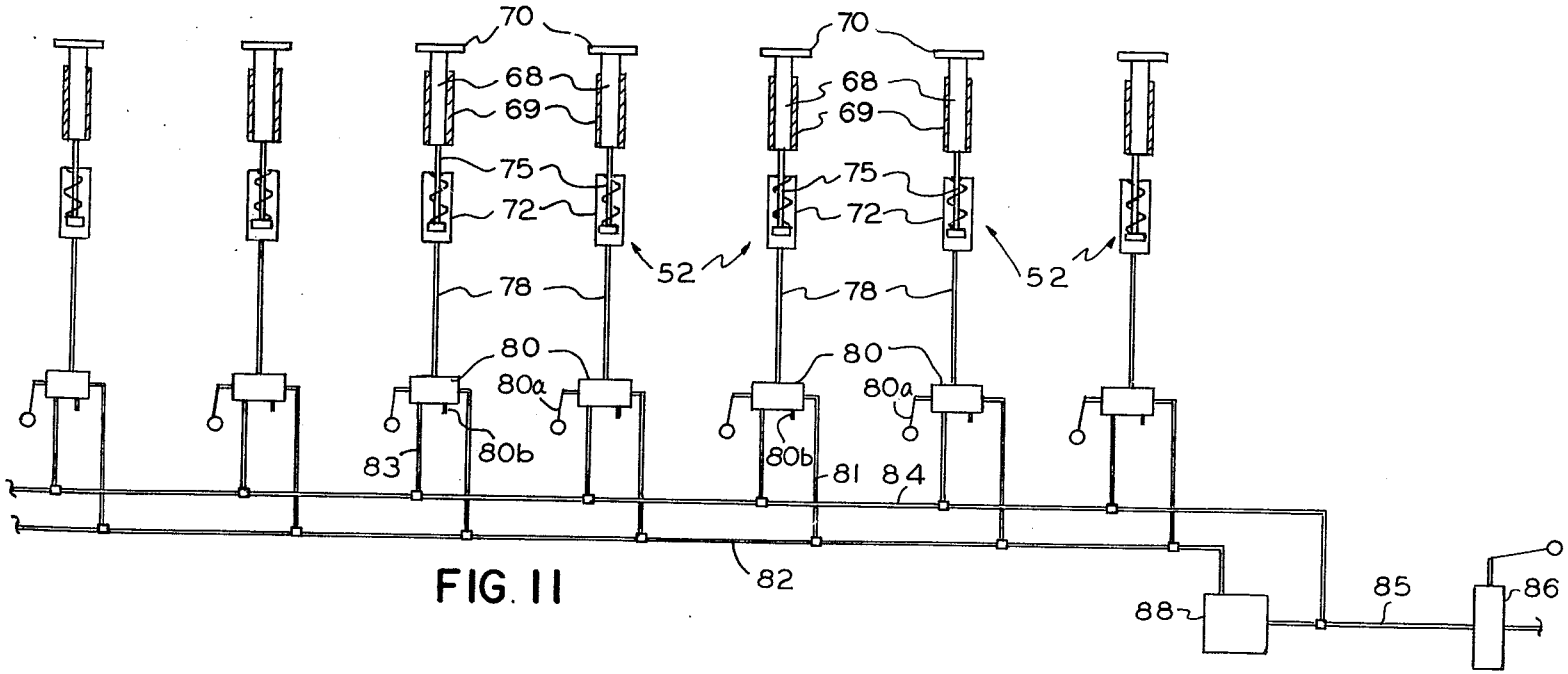
FIG. 11 is a schematic diagram of an air-operated lumber lock system of the present invention.
Figure 12:
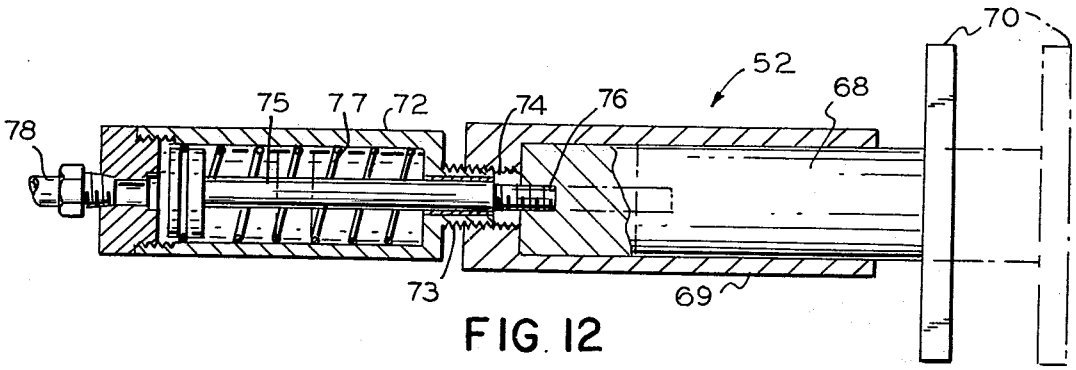
FIG. 12 is a sectional view through one of the lumber-locking mechanisms of FIG. 11.

Another accessory of the jig table important to rapid truss production is a lumber-clamping means used to hold the truss frame members together at their joints on the pressure pads prior to embedment of the connector plates by the press. Such clamping means is shown in FIGS. 5, 11 and 12. It includes the aforementioned conventional lumber stop 50 fastened to pressure pad 42, an air-operated lumber-locking means including the locking mechanism 52 mounted on the same pad 42 and an air control system illustrated schematically in FIG. 11. The control system is designed to release simultaneously all of the locking mechanisms from their respective joints to facilitate rapid removal of a completed truss from the jig table. There is normally a lumber-locking mechanism 52 and stop 50 provided at each joint to maintain the wooden frame members in edge abutment prior to and during the embedment of the connector plates.

Referring to FIGS. 5 and 12, lumber-locking mechanism 52 includes a cylindrical plunger 68 mounted for sliding movement within a sleeve 69 and having a striker plate 70 at its free end for engagement with the lumber. Sleeve 69 is secured to a vertical portion of an angular base plate 71 fastened to the top plate of pressure pad 42. A light-duty single-acting air cylinder 72 has a threaded neck portion 73 threaded into a rear nut portion 74 of sleeve 69 to mount the air cylinder on and in axial alignment with the sleeve. The air cylinder includes a piston having a piston rod 75 threaded at its forward end 76 into a rear threaded opening in plunger 68 within sleeve 69. A coil spring 77 within the air cylinder normally biases the piston rod 75 in a retracted position, thus maintaining plunger 68 and its striker plate 70 also in a retracted position. An air supply line 78 extends from a rear end port in the air cylinder to a manually operated, pilot air releasable air valve 80, also carried by base plate 71.

Referring to FIG. 11, there is an air valve 80 for each lumber lock. Such valve includes a manual operating handle **80*a* at one end for manually positioning the valve to admit air to or release air from the air cylinder 72 and thus apply or release the lock. A pilot air line 81 leads to the opposite end of the valve from a primary pilot air line 82 connected to a pneumatically operated valve, relay and timer 88. An air supply line 83 leads to valve 80 from a primary air supply line 84. Both supply line 84 and valve-relay-timer 88 are connected through a common air line 85 to a remote manually operated master control valve 86 which controls the admission of pressurized air to line 85** from an air pressure source (not shown).

In practice, at the beginning of truss assembly, the actuating levers **80*a* of all lumber locks 52 are in a closed position to prevent air from supply lines 84 and 81 from passing through valves 80 and lines 78 to air cylinders 72. Master control valve 86 is opened to pressurize line 85 and thus lines 84 and 81 to the valves 80. This also charges valve-relay-timer 88 to prevent pilot air flow to the valves 80** through the valve-relay-timer.

Each lumber lock is normally applied individually through shifting of the manual override lever **80*a* to a position which opens the valve 80 to the passage of air from line 83 to line 78 and the selected air cylinder 72 to shift piston rod 75 outwardly against spring pressure and force striker 70 of plunger 68 against the lumber, clamping the lumber against lumber stop 50. However, after all of the locks have been applied and the truss completed, the locks are released simultaneously from their respective joints for quick removal of the truss from the jig table simply by closing master control valve 86. This cuts off air pressure to the valve portion of valve-relay-timer 88 to open such valve portion, sending a pulse of air from the relay through pilot lines 82 and 81 to close valves 80 by shifting their valve spools and levers 80*a* to their closed positions. This opens air lines 78 from the air cylinders to exhaust through an exhaust port 80*b* at each valve 80. After valves 80 are reclosed, pilot air in lines 82 and 81 is gradually bled off through an orifice in valve-relay-timer 88 so that when any of valves 80** are manually reopened, there will be insufficient pilot air pressure at such valves to reclose them.

The foregoing lumber stop construction enables the use of a relatively light-duty inexpensive air cylinder to transmit a sufficient clamping force through the plunger and striker to effectively clamp a truss joint during assembly and pressing of the truss.

Press Details

Figure 2:
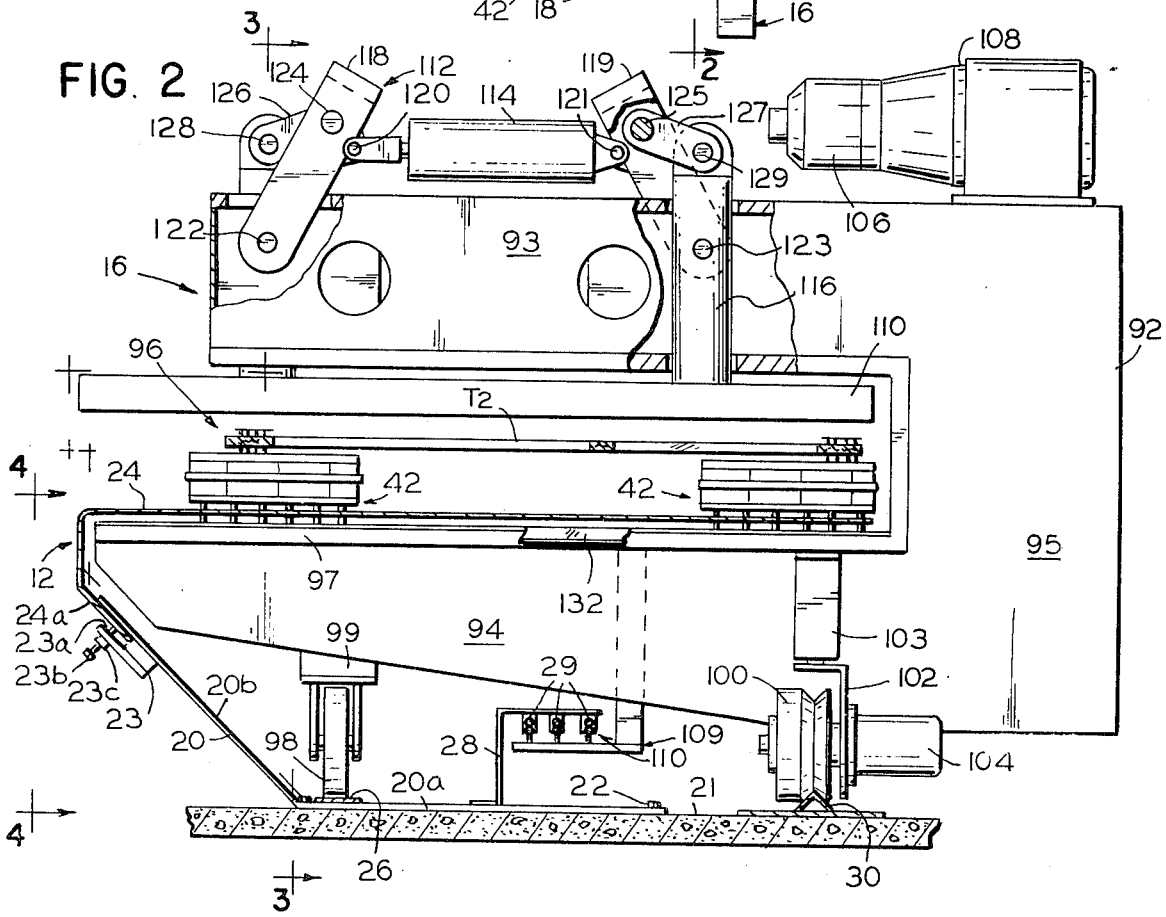
FIG. 2 is a vertical sectional view taken along the line 2—2 of FIG. 1 showing the jig table and the press of the system, the latter in side elevation, with parts broken away for clarity.
Figure 3:
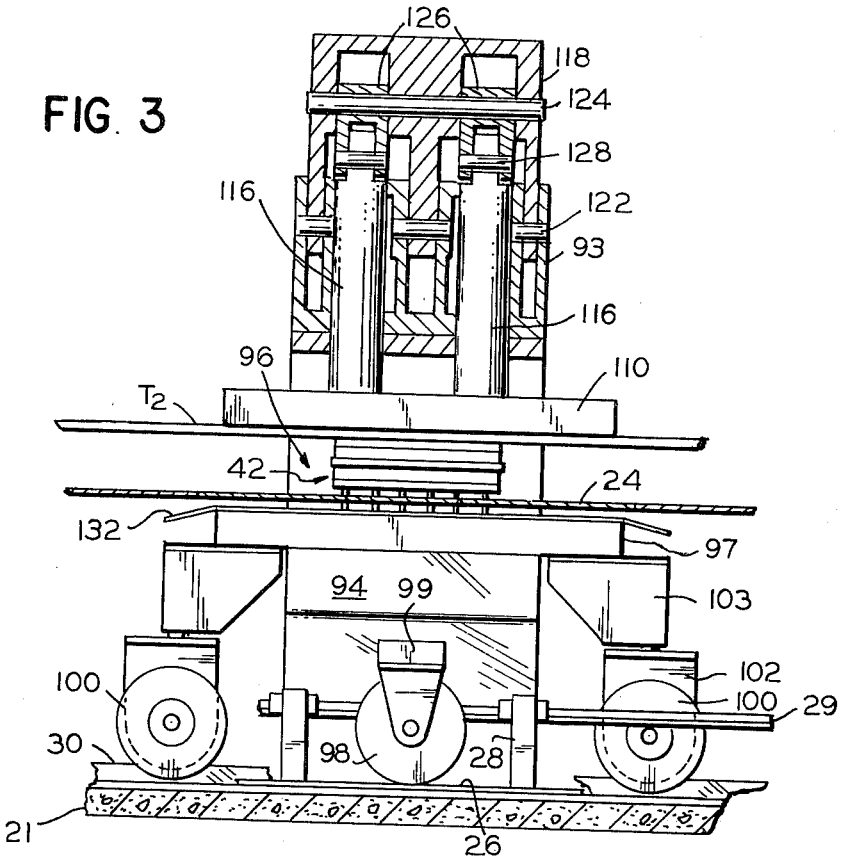
FIG. 3 is a view on the same scale as FIG. 2 taken approximately along the lines 3—3 of FIG. 2 to show an end of the press with its upper portion in section and with its upper press platen fully extended.

The details of press 16 are shown most clearly in FIGS. 2 and 3. The press includes a generally C-shaped frame 92 including an upper frame portion 93 and a lower frame portion 94 interconnected by an end frame portion 95 which together define an open throat at 96. The horizontally extending table top portions 24 of jig tables 10 and 12 are sized and at a level such that they can extend into this throat from its open side without interference as shown in FIG. 2. Thus lower frame portion 94 of the press extends into the space below the table top 24 from the unsupported open side of the table while the upper frame portion 93 extends over the table top. The press can therefore travel unobstructed on its trackway along the lengths of the jig tables. It will be observed that lower frame portion 94 has a shape generally complementary to the cross-sectional shape of the table sections.

Lower frame portion 94 mounts the fixed lower press platen 97 which, as shown in FIG. 3, extends laterally outwardly from the lower frame portion in the direction of movement of the press. Upper frame portion 93 mounts an upper press platen 110 movable toward and away from the lower platen within the throat 96. Both platens span the entire single-module width of the jig tables so that they can press at any point on the tables. They are also quite wide and may thus span and press several truss joints simultaneously.

The press is mounted on three wheels including a caster wheel 98 mounted directly to an undersurface of lower frame portion 94 through a swivel mount 99 for movement along the flat rail 26. The other two wheels are a pair of driven wheels 100 rotatably carried by a support bracket 102 depending from a swivel mount 103 secured to an underside of lower press platen 97. Each of wheels 100 is driven by a hydraulic wheel motor 104. Hydraulic pressure fluid is circulated through wheel motors 104 by a hydraulic pump 106 and suitable hydraulic lines (not shown). Pump 106 is driven by an electric motor 108 carried on upper press frame portion 93. The driven wheels 100 are suitably grooved to travel on the angular rail member 30.

Electric motor 108 takes its power from the "third rail" 29, actually three separate power-conducting rails, beween the wheel rails 26, 30, through a suitable power takeoff means at 109 on the press. From such means the electrical power is transmitted through suitable conductors (not shown) to motor 108.

Lower press platen 97 includes declining leading and trailing apron portions 132 as shown clearly in FIGS. 3 and 6. These apron portions, as previously mentioned, provide camming surfaces which are at such a level with respect to table top 24 that the leading one of such aprons initially engages an edge row of positioning pins 56 on a pressure pad 42 at a joint to be pressed as the press approaches such joint along its trackway. As the apron engages the first row of positioning pins, it cams such pins upwardly, lifting one edge of the pad from the table surface. As the lower platen moves further under the pad, apron 132 progressively cams each succeeding row of pins upwardly in their index holes 32 until the entire pad is raised slightly from the table surface. When the pad is fully raised, its supported truss joint can be pressed without transmitting press forces to the table.

Upper frame portion 93 of the press mounts upper platen 110 for vertical reciprocation. The upper platen is moved toward and away from fixed lower platen 97 by a toggle-actuating mechanism indicated generally at 112 operated by a single hydraulic cylinder 114 to which hydraulic pressure fluid is supplied by pump 106. FIG. 2 shows the toggle mechanism and thus upper platen 110 in their retractive positions. FIG. 3 shows the same toggle mechanism and upper platen in their fully extended positions.

The toggle mechanism includes a pair of push rods 116 extending upwardly from each end of upper platen 110 through upper frame portion 93 and slidable loosely within such portion. The opposite ends of cylinder 114 are pivotally connected to a pair of long link members 118, 119 at pivots 120, 121. The lower ends of long links 118, 119 in turn are pivoted respectively at pins 122, 123 to upper frame portion 93. An upper portion of each long link 118, 119 is pivoted respectively by long pivot rods 124, 125 to one set of ends of short links 126, 127. The opposite ends of such short links are pivoted at 128, 129 to the upper ends of the pairs of push rods 116.

With the foregoing arrangement, the free-floating cylinder 114 when retracted maintains the toggle mechanism and upper platen in their retracted positions shown in FIG. 2, with the upper platen spaced a short distance above the connector plates P and truss T-2 supported on pressure pads 42. Upon extension of cylinder 114, long links 118, 119 of the toggle mechanism are pivoted toward their vertical positions shown in FIG. 3. These in turn rotate the short links 126, 127 toward more nearly vertical positions, thereby transmitting forces through the short links and their connections 128, 129 to the push rods, forcing the push rods and the connected upper press platen downwardly through a short but forceful pressing stroke. Retraction of cylinder 114 swings the toggle links in the opposite direction to retract the upper platen upwardly. The geometry of the toggle mechanism is such that forces transmitted to the upper platen by the mechanism increase progressively as the long links approach a more nearly vertical position. This progressive increase in forces corresponds to the usual progressively increasing resistance of the connector plates P to embedment in the frame members of the truss T-2 so that maximum pressures are applied by the platen when they are most needed. This feature provides a highly efficient use of available power and enables use of a relatively small hydraulic cylinder to generate the needed press capacity.

SUMMARY OF OPERATION

In operation, a crew of workmen select the proper precut wooden frame members to make up the truss T-2 on large table 12 of FIG. 1. Pressure pads 42 of the proper sizes and thicknesses are positioned at points on table 12 where the joints of the various truss frame members will fall. The pressure pads are maintained in such positions by inserting their positioning pins through selected indexing holes 32 in the top 24 of the table. Then the various frame members for the truss are assembled on the table with their joints supported on the pressure pads. A pair of metal connector plates P are placed at each joint, one beneath the joint resting on the pressure pad and one over the joint in the manner shown in FIG. 6 with respect to connector plates P-1 and P-2.

A lumber stop 50 is secured to each pressure pad in a position for abutment against one of the frame members at each joint. One of the air-operated lumber locks 52 is also secured to each pad in a position to clamp the joint between the lock and the stop, in the manner shown, for example, in FIG. 5. When the frame members are properly positioned on a pad between the stop and lock, the lock lever 80*a* is actuated to open valve 80 and transmit air to air cylinder 72, forcing the lock striker 70 against the joint. Other joints of the truss are assembled in a similar manner until all of the lumber locks are energized to hold the truss joints together with the connector plates P in place.

With the truss members thus assembled and ready for fastening, press 16, which may be operated by remote control, moves along its trackway to table 12. At the table the press moves progressively from joint to joint, first lifting a pad slightly from the table then stopping momentarily and pressing the connector plates into the truss joint supported on the pad through extension of hydraulic cylinder 114 to move upper press platen downwardly against the frame members. Thereafter cylinder 114 is retracted to withdraw the upper platen and permit the press to move along the table to the next joint or series of joints where the sequence is repeated.

When all joints of truss T-2 have been pressed, which will require the truss to travel around curve 14*a* of trackway 14 to the inner half of table 12 to press the topmost joint of the truss, the press moves back along the trackway to table 10. There another truss T-1 has been assembled on jig table 10 while truss T-2 was pressed on table 12.

With truss T-2 completed, lumber-locking mechanisms 32 are disengaged to release the pressed joints from their pad by actuation of master control 86 of the air lock system shown in FIG. 11. Then rollers 60 on table 12 are moved from their retracted positions to their extended positions shown in solid lines in FIG. 8, thereby lifting the completed truss from the pressure pads. A crew then rolls truss T-2 from an end of jig table 12 and transports it to a storage site for shipment.

Following removal of completed truss T-2 from jig table 12, a crew immediately begins to assemble another truss on table 12 where the sequence just described will be repeated. If the next truss to be fabricated on table 12 is identical to the preceding truss, pressure pads 42 will remain in their original positions as will the lumber locks and stops on such pads so that fabrication proceeds at a rapid rate. As the next truss is assembled on jig table 12, the pressing of truss T-1 proceeds at table 10.

In the foregoing-described manner, one or more self-propelled presses moving along a trackway 14 used in conjunction with one or several jig tables such as the jig tables 10 and 12 can be used in a manner to fabricate trusses at an exceptionally high rate, with a high degree of safety for the workmen and with low worker fatigue and a minimum work force.

It will be appreciated that the plant layout of FIG. 1 is only an example as is the foregoing operating sequence. Many different layouts and variations in procedure are possible using the described press and jig table system.

Having illustrated and described what is presently a preferred form of the invention, it should be apparent to those persons skilled in the art that the same permits of modification in arrangement and detail. I claim as my invention all such modifications as come within the true spirit and scope of the following claims.

I claim:

1. Apparatus for embedding connector plates in the joints of wooden frame members to form trusses and the like, comprising:

a traveling press means movable along a trackway for pressing said connector plates into said joint, said press means having a self-propelled generally C-shaped rigid frame defining an open throat with upper and lower press platens mounted within said throat, one for movement toward the other, a stationary jig table including a continuous planar panel-like, stationary tabletop of sufficient expanse to support multiple joints of said wooden frame members, said tabletop being positioned along said trackway and cantilevered generally horizontally from support means at one side of said table to define an unsupported open opposite side and open ends, said tabletop being at a level such that said open opposite unsupported side of said tabletop projects into said open throat between said upper and lower platens when said press means travels along said table, said platens being sized to span substantially the full width of said jig table such that said platens can embed connector plates adjacent both opposite side edges of said tabletop while projecting over and under said tabletop from said unsupported side.

2. Apparatus according to claim 1 wherein said trackway extends along a floor beneath said jig table top.

3. Apparatus according to claim 1 wherein said press means includes electric motor means driving hydraulic pump means, said pump means supplying pressure fluid to a hydraulic motor means for driving one of said press platens and to a hydraulic wheel motor means for propelling said press means, electrial conductor rail means extending along the path of travel of said press means and connected to a source of electrical power, said press means including electrical power takeoff means connected to said conductor rail means for transmitting electrical power to said electric motor means.

4. Apparatus according to claim 1 wherein said jig table includes a table top with a network of equally spaced-apart indexing holes extending therethrough, a series of pressure pads for supporting the joints of said frame members on said table top, each said pad having a plurality of equally spaced-apart positioning pins of equal length projecting from a bottom surface thereof with the spacing between said pins corresponding to the spacing between said indexing holes and with said pins being sized to be received within said holes, the lengths of said pins being greater than the thickness of said table top so that the lower ends of said pins project below said table top when said pins are inserted through said holes, the lower platen of said press means having an upper surface above the level of the lower ends of said pins when said pins are inserted through said holes, said lower platen including a camming surface for engaging the lower ends of said pins and pushing said pins upwardly within said index holes to raise the associated said pressure pad from said table top as said press means moves along said table, whereby pressing forces applied by said press means are transmitted from one platen to the other through said pressure pads without being applied to said jig table.

5. Apparatus according to claim 4 wherein said means for engaging and pushing said pins includes a downturned edge portion of said lower platen, said edge portion extending at a declination from the upper surface of said lower platen in the direction of travel of said press means to provide said camming

6. Apparatus according to claim 1 including at least two said jig tables spaced apart along a common said trackway and a single said traveling press movable along said trackway between said jig tables, each said jig table being of a size sufficient to support a complete frame structure to be fabricated, such that said press can be shuttled between and used in cooperation with both said jig tables alternately by pressing connector plates into the frame members of a frame structure on one said table while a separate frame structure is assembled preparatory to pressing on the other said table.

7. Apparatus according to claim 1 wherein said tabletop is perforate to provide a grid of index holes for locating joint- and connector plate-supporting pressure pads in fixed but variable predetermined positions on said tabletop.

8. Apparatus according to claim 1 wherein said jig table includes a tabletop with a network of equally spaced-apart indexing holes extending therethrough, a series of pressure pads for supporting the joints of said frame members on said table top, each said pad having a plurality of equally spaced-apart positioning pins of equal length projecting from a bottom surface thereof with the spacing between said pins corresponding to the spacing between said indexing holes and with said pins being sized to be received within said holes, the lengths of said pins being greater than the thickness of said tabletop so that the lower ends of said pins project below said tabletop when said pins are inserted through said holes, said lower platen of said press means including means for engaging and lifting said pins upwardly within said indexing holes to raise the associated said pressure pad from said tabletop so that pressing forces of said press means are transmitted from one said platen to the other through said pins and pressure pads without being applied to said jig tabletop.

9. In an apparatus for embedding connector plates into the joints of wooden frame members to form a truss or the like, including a stationary jig table for supporting said frame members and for cooperation with a traveling press, said jig table comprising:

a generally planar, plate-like stationary table-top having a continuous expanse sufficient to support multiple joints of a truss to be formed thereon, stationary support means for supporting said tabletop above a floor surface, said tabletop being provided throughout its top expanse with a continuous network of indexing holes extending therethrough at equally spaced-apart intervals from end to end and from side to side of said table for locating a series of frame joint- and connector plate-supporting pressure pads in fixed but variable predetermined positions on said tabletop.

10. Apparatus according to claim 9 including a series of pressure pads for supporting said connector plates and said frame members at their joints on said table top, a series of equally spaced-apart positioning pin means of equal length projecting downwardly from a bottom surface of each said pad, the spacing between said pin means corresponding to the spacing between said indexing holes, said pin means being sized to be received within said holes, the length of said pin means being greater than the thickness of said table top so that the lower ends of said pin means project below said table top when said pin means are inserted in said holes, said pads being movable to various positions on said table top and maintained in said positions by inserting said pin means in selected ones of said holes.

11. Apparatus according to claim 10 wherein said indexing holes are tapered outwardly in a downward direction from upper portions thereof and at least the corner said positioning pin means of said pads are tapered inwardly in a downward direction from upper portions thereof, said upper portions of said pin means being sized to fit under close tolerances within said upper portions of said holes.

12. Apparatus according to claim 10 including a press means having a press frame movable along said table, said frame supporting an upper press platen extending horizontally at a level above said table top and said pressure pads, a lower press platen supported on said frame and extending horizontally at a level below said table top, said press platens being movable vertically relative to one another toward and away from said table top, said lower platen being positioned at a level and shaped to engage the lower ends of said positioning pin means and push said pin means upwardly within said index holes to raise the associated said pressure pads out of engagement with said table top as said press means travels along said table and to maintain said pads out of engagement during the application of pressure to frame members and connector plates supported on said pads.

13. Apparatus according to claim 10 including a series of roller means extending across a substantial width of said jig table top at intervals along the length of said table, said roller means being shiftable between inactive positions below the upper level of said pressure pads and active truss-supporting positions above the level of said pads for rolling a completed truss horizontally from said table.

14. Apparatus according to claim 10 including locking means for attachment to said pressure pads for clamping said frame members together at their joints preparatory to pressing, each said locking means including a plunger slidable within a sleeve, a striker means at one end of said plunger outwardly of one end of said sleeve for engaging a frame member, an air cylinder means connected to the opposite end of said sleeve in axial alignment therewith, said cylinder means including a piston rod extending through said opposite sleeve end and into threaded engagement with a rear end of said plunger for reciprocating said plunger and its said striker means.

15. Apparatus according to claim 14 including an air valve means on said pads, one of said valve means being operably connected to said cylinder means of each said locking means, each said air valve means being individually manually operable to admit air from an air pressure source to said cylinder means and being remotely operable simultaneously with other said valve means by pilot air pressure to exhaust air from said cylinder means and thereby release all said locking means at the same time.

16. Apparatus according to claim 9 wherein said indexing holes are tapered outwardly in a downward direction from upper portions of said holes to provide for ready insertion of indexing pins of said pressure pads downwardly into and removal of said indexing pins upwardly from said indexing holes without binding.

17. Apparatus according to claim 9 wherein said jig table is composed of table sections of equal lengths, equal widths and equal heights joined together by connector means operable to maintain the predetermined indexing hole spacing between table sections, whereby said table can be made up in variable increments of length to accomodate trusses of greatly different lengths.

18. Apparatus according to claim 17 wherein each said table section has a panel-like table top portion at a level approximately waist-high to a worker standing alongside said table and a length such that workers at opposite sides of said table section can reach any point on said table top portion, whereby a truss can be assembled on said jig table, pressed and removed therefrom without workers working on said table top and while said truss remains at a low level with respect to said workers.

19. Apparatus according to claim 9 wherein a pair of said jig tables are joined side to side to provide an expanded width table means to accomodate large deep trusses, and connector strap means cooperable with said indexing holes of said pair of tables for joining said tables together while maintaining said indexing hole spacing between said tables.

20. Apparatus according to claim 9 wherein said support means comprises leg means extending upwardly from a floor surface and connected to one side of said tabletop, said tabletop being cantilevered horizontally from said leg means and being unsupported at the side opposite said one side and between said sides such that said opposite side and opposite ends of said table are open to enable a platen of a C-shaped traveling press to enter sideways below said tabletop as said press travels along the said open side of said table.

21. Apparatus according to claim 20 wherein said leg means includes multiple angular leg members aligned along one side of said tabletop, each leg member including a ground-engaging base portion extending horizontally inwardly beneath said tabletop and a top-supporting leg portion inclined upwardly and outwardly from an outer end of said base portion, table top-clamping means fixed to an upper portion of said top-supporting leg portion, said tabletop including multiple panel-like top sections joined together side by side, each said top section comprising a one-piece perforate flat top plate extending horizontally over said ground-engaging base portion and being downturned at one end thereof, said downturned end being clamped in said clamping means of said top-supporting leg portion.

22. Apparatus according to claim 9 wherein said indexing holes are of equal diameter and the side-to-side spacing between holes equals the end-to-end spacing between holes throughout the top expanse of said tabletop, said holes being arranged in rows parallel to the side and end edges of said tabletop.

23. In an apparatus for embedding connector plates into the joints of wooden frame members arranged on a jig table to form a truss or the like, a press for movement along a trackway for pressing connector plates into said frame members on said jig table, said press comprising:

a generally C-shaped rigid press frame including vertically spaced upper and lower frame portions defining an open throat therebetween positioned at a level for receiving a jig tabletop, said lower frame portion being supported on wheels for travel along a ground-level trackway, said press frame otherwise being vertically and horizontally immovable when operative, self-propelling means carried by said frame for propelling said press frame along said trackway, a vertically movable upper press platen carried by said upper frame portion at a position to overlie said tabletop, a stationary lower press platen carried by said lower frame portion at a position to underlie said tabletop, platen drive means carried by said frame for effecting vertical movement of said upper platen toward and away from said lower platen for pressing connector plates into said frame members, said upper and lower press platens being sized to extend across substantially the full width span of a jig tabletop sized to support at least a substantial portion of the wooden frame structure to be formed including multiple joints thereof.

24. Apparatus according to claim 23 wherein said propelling means comprises hydraulic wheel motor means drivingly connected to at least one of said wheels, hydraulic pump means on said frame for transmitting hydraulic pressure fluid to said wheel motor means, an electric motor on said frame for driving said pump means, and electrical power pickup means on said frame for engaging a power rail means extending along the path of travel of said press for receiving electrical power from said power rail means and transmitting said power to said electric motor means.

25. Apparatus according to claim 23 wherein said platen drive means comprises at least two vertical push rod means extending upwardly from outer and inner portions respectively of said upper platen and extending upwardly through said upper frame portion to mount said upper platen for vertical movement, a pair of toggle-actuating mechanisms being connected one to each of said two push rod means and to said upper frame portion for reciprocating said upper platen, and an extensible fluid-powered cylinder means extending horizontally between and pivoted at its opposite ends to said pair of toggle-actuating mechanisms, said pair of toggle-actuating mechanisms being interconnected only by said cylinder means so that said pair of mechanisms operate independently of one another to activate their respective said push rod means.

26. Apparatus according to claim 25 wherein each of said toggle mechanisms includes a long link pivoted at a lower portion thereof to said upper frame portion at a first pivot point, a short link pivoted at one end to an upper portion of the associated said push rod means at a second pivot point and pivoted at an opposite end of said long link at a third pivot point above said first pivot point, said extensible cylinder means being pivoted at one end to said long link at a fourth pivot point above said first pivot point, said cylinder means when retracted maintaining said long links at a vertical inclination and said short link at a greater inclination to the vertical and when extended forcing said long and short links toward the vertical to move said push rod means and said upper platen downwardly.

27. Apparatus according to claim 23 wherein said lower press platen includes leading and trailing apron portions declining outwardly from a generally horizontal main platen body to provide camming surfaces for engaging and lifting wooden frame-supporting pressure pads on a jig table beneath which said lower platen travels.

28. In an apparatus for prefabricating a wooden truss or other wooden frame structure wherein a stationary jig table with a perforate plate-like top for supporting at least a portion of said frame structure at a joint thereof cooperates with a traveling press for pressing connector plates into said joint, the improvement comprising:

a pressure pad for supporting a joint of the frame structure on said tabletop during the pressing operation, said pad including flat parallel top and bottom surfaces, said top surface for supporting an assembly of connector plates and a frame joint, said bottom surface for engagement with said tabletop, a plurality of equally spaced-apart positioning pins of equal length projecting from said bottom surface, with the spacing between said pins corresponding to the spacing between perforations in said tabletop, said pins being sized to be received within corresponding said perforations, the lengths of said pins being greater than the thickness of said tabletop so that lower ends of said pins project below said tabletop when said pins are inserted into said perforations with said bottom surface of said pad engaging said tabletop, whereby the lower ends of said pins can be raised within said perforations to lift said pad and its supported joint from said tabletop by a lower platen of a press so that pressing forces to assemble said joint are transmitted through said pad but not through the tabletop.

29. Apparatus for embedding connector plates in the joints of wooden frame members to form trusses and the like, comprising:

a traveling press means movable along a ground-level trackway for pressing said connector plates into said joint, said press means having a generally C-shaped frame defining an open throat with upper and lower press platens mounted within said throat, one for movement toward the other, said C-shaped frame being mounted on wheels movable along said trackway, a jig table for supporting said wooden frame members positioned along said trackway and including a flat continuous and horizontally rigid tabletop cantilevered over said trackway from support means at one side of said table and trackway at a level such that said tabletop projects into said open throat between said upper and lower platens when said press means travels along said table on said trackway, said tabletop being of sufficient continuous expanse horizontally to support multiple joints of said wooden frame members and said platens having sufficient reach to extend across substantially the full width of said cantilevered tabletop.

30. In an apparatus for embedding connector plates into the joints of wooden frame members to form a truss or the like, including a stationary jig table for supporting said frame members and for cooperation with a traveling press, said jig table comprising:

a generally flat, plate-like horizontally rigid tabletop having a sufficient continuous horizontal expanse to support multiple joints of a truss to be formed, support means for supporting said tabletop above a floor surface, said tabletop being provided with a network of indexing holes therethrough at equally spaced-apart intervals from end to end from side to side of said table for locating a series of frame joint and connector plate supporting pressure pads in fixed but variable predetermined positions on said tabletop, said support means being supportively connected to one side edge portion of said tabletop, said tabletop being cantilevered generally horizontally from said one side edge portion to provide an opposite unsupported side edge portion defining the upper limits of an opening beneath said tabletop providing access for said traveling press.

31. In an apparatus for embedding connector plates into the joints of wooden frame members arranged on a jig table to form a truss or the like, a press for movement along a trackway for pressing connector plates into said frame members on said jig table, said press comprising:

a generally C-shaped rigid press frame including vertically spaced upper and lower frame portions defining an open throat therebetween positioned at a level for receiving a jig tabletop, said lower frame portion being supported on means for travel along a ground-level trackway, said press frame otherwise being vertically and horizontally immovable when operative, means for propelling said press frame along said trackway, a vertically movable upper press platen carried by said upper frame portion at a position to overlie said tabletop, a stationary lower press platen carried by said lower frame portion at a position to underlie said tabletop, platen drive means carried by said frame for effecting vertical movement of said upper platen toward and away from said lower platen for pressing connector plates into said frame members, said upper and lower press platens being of sufficient horizontal expanse to extend across substantially a full unsupported width span of a jig tabletop sized to support at least a substantial portion of the wooden frame structure to be formed including multiple joints thereof.

* * * * *

UNITED STATES PATENT OFFICE
CERTIFICATE OF CORRECTION

PATENT NO. : 3,939,764

DATED : February 24, 1976

INVENTOR(S) : Gerald M. McCormack

It is certified that error appears in the above-identified patent and that said Letters Patent are hereby corrected as shown below:

Column 6, line 12, "core 42" should be --core 43--;
Column 11, line 38, "32" should be --52--;
Claim 3, column 12, line 43, "electrial" should be --electrical--;
Claim 5, column 13, line 13, after "camming" insert --surface.--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*